United States Patent [19]

Przybylinski et al.

[11] Patent Number: 4,630,547

[45] Date of Patent: Dec. 23, 1986

[54] CROSS BEARER ARRANGEMENT FOR SLOTTED CENTER SILL

[75] Inventors: Phillip G. Przybylinski, Schererville; John H. Spence, Munster, both of Ind.

[73] Assignee: Pullman Standard Inc., Chicago, Ill.

[21] Appl. No.: 597,028

[22] Filed: Apr. 5, 1984

[51] Int. Cl.[4] ..... B61D 17/00

[52] U.S. Cl. ..... 105/416; 105/419; 280/787; 52/729

[58] Field of Search ..... 105/413, 414, 418, 416, 105/417, 419; 280/786, 787; 52/729, 730, 731

[56] References Cited

U.S. PATENT DOCUMENTS

| | | | |
|---|---|---|---|
| 727,488 | 5/1903 | Swanson | 105/418 |
| 952,028 | 3/1910 | Becker | 105/419 |
| 1,078,310 | 11/1913 | Rohlfing | 105/414 |
| 2,788,750 | 4/1957 | Priest | 105/416 X |

*Primary Examiner*—Robert B. Reeves
*Assistant Examiner*—Glenn B. Foster
*Attorney, Agent, or Firm*—Richard J. Myers & Assoc.

[57] ABSTRACT

A railway car underframe includes a center sill having a central section and opposite end sections. The sill includes spaced vertical walls, and upper and lower walls which are slotted in registry the length of the central section, and which form in cross section a spaced I-beam construction. The construction provides a sill having high torsional flexibility which is necessary to accommodate the railway car to track conditions tending to derail the car when single axle suspensions with two wheels are utilized. The sill also includes a separator in the form of a channel which includes flanges at its sides which are secured to the vertical walls of the sill. The separator extends substantially the length of the slots and is effective to resist lateral forces tending to buckle or permanently deform the sill during operation, while not adversely affecting the high torsional flexibility which is required in the sill structure. The railway car further includes a cargo or load bearer construction having cantilevered cross bearer members which include vertical webs with upper and lower flanges projecting outwardly from the sill. The cross bearers engaged with the central portion of the sill are interconnected by straps extending through the sill. A tie member connects the lower I-beam portions of the sill to permit longitudinal displacement of the lower I-beam portion relative to each other in a limited manner thereby maintaining the required torsional flexibility.

14 Claims, 10 Drawing Figures

CROSS BEARER ARRANGEMENT FOR SLOTTED CENTER SILL

BACKGROUND OF THE INVENTION

This patent application is related to U.S. patent application Ser. No. 553,252 filed on Nov. 18, 1983 and entitled Center Sill Horizontal Divider by applicants Henry K. Wiger and Phillip G. Przybylinski and U.S. patent application Ser. No. 553,316 filed on Nov. 18, 1983 and entitled Double Groove Center Sill by applicants Henry K. Wiger and Manfred Katz.

1. Field of the Invention

This improvement relates to the field of flat railway cars having a torsionally flexible center sill to accommodate conditions occurring with the use of a single axle suspension truck which, due to track irregularities, may cause structural problems.

2. Description of the Prior Art

In the present improvement the center sill and associated structure is made torsionally flexible by the use of a slotted sill and other associated structures which accommodate operating conditions occurring as a result of track conditions. Slotted center sills are old in the prior art as indicated in Fenstermacher et al. U.S. Pat. No. 2,217,683 which includes a rigid structure having no torsional flexibility, the utilization of the slot merely being for the purpose of taking weight out of the structure. The Miller et al. U.S. Pat. No. 3,777,671 also discloses a rigid underframe having a sliding sill with a transverse divider plate. Neither of these patents relate to the present improved design.

SUMMARY OF THE INVENTION

The present improvement resides in a unique cross bearer design which is compatible with the torsional flexibility of the center sill described in the aforementioned applications. Each cross bearer consists of two parts, each of which is cantilevered off of one side of a center sill I-beam. The cross bearers comprise upper and lower flanges and vertical webs. Upper connecting straps extend through aligned openings and interconnect the upper flanges of the cross bearers. Lower vertical straps interconnect the lower horizontal plate portions and lower portions of the webs. A lower strap plate interconnects the lower horizontal flanges of the cross bearers.

DESCRIPTION OF THE PREFERRED EMBODIMENT

Figures 1, 2, 3:
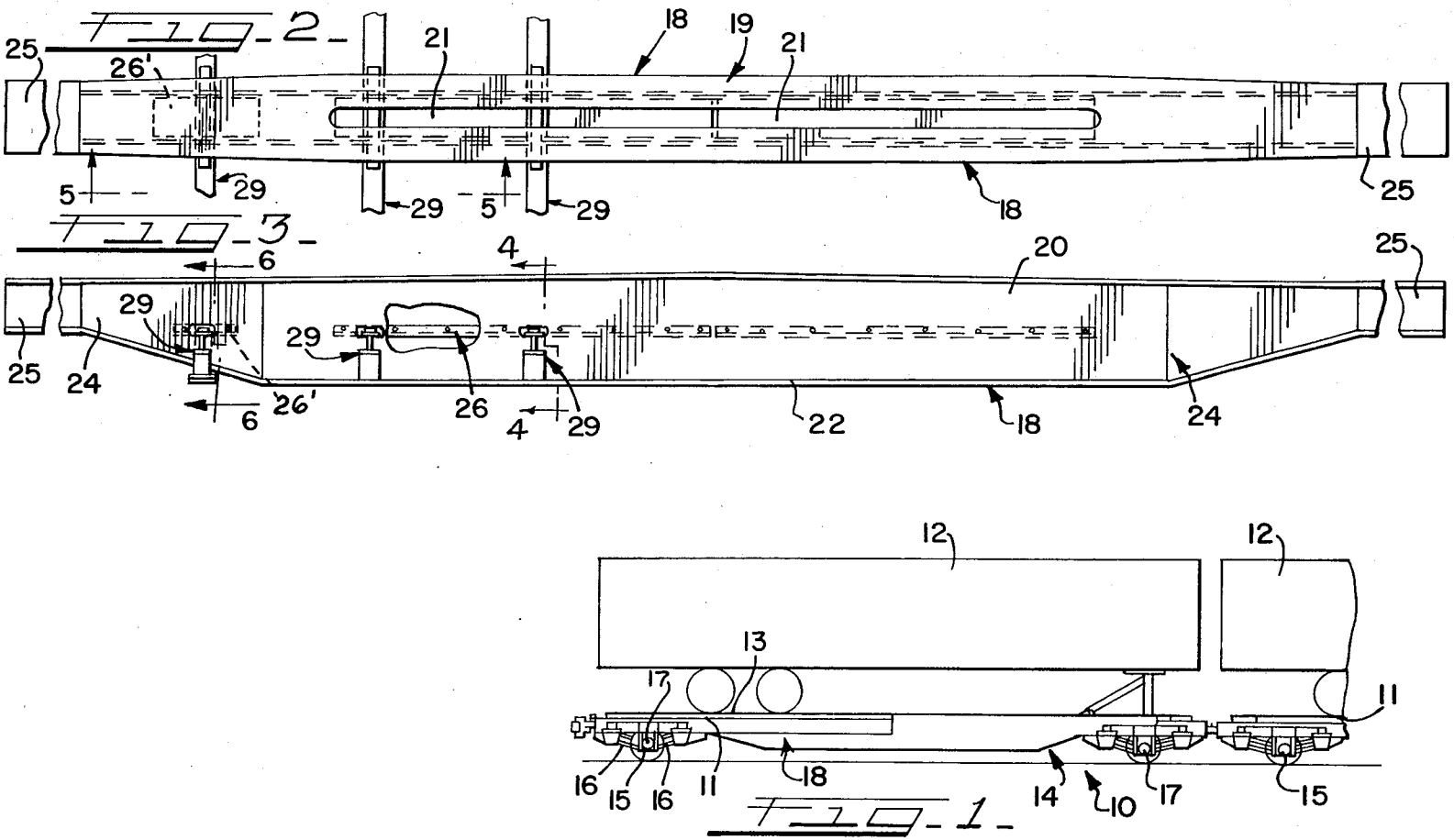
FIG. 1 is a side elevational view of a two flat car train having single axle trucks.
FIG. 2 is a plan view of an improved center sill, also disclosing the cross bearers connected to the sill.
FIG. 3 is a side elevational view of the sill and deck structures of FIG. 2.

Referring to the drawings, and particularly FIG. 1, a railway car train 10 comprises two flat cars 11 which may each carry a load such as a highway cargo trailer 12. The cars 11 each include cargo support ramps or deck members 13 and an underframe 14. The underframe 14 is supported on its ends on a single axle suspension 15 having suitable spring support 16 and a single axle 17.

Figure 4:
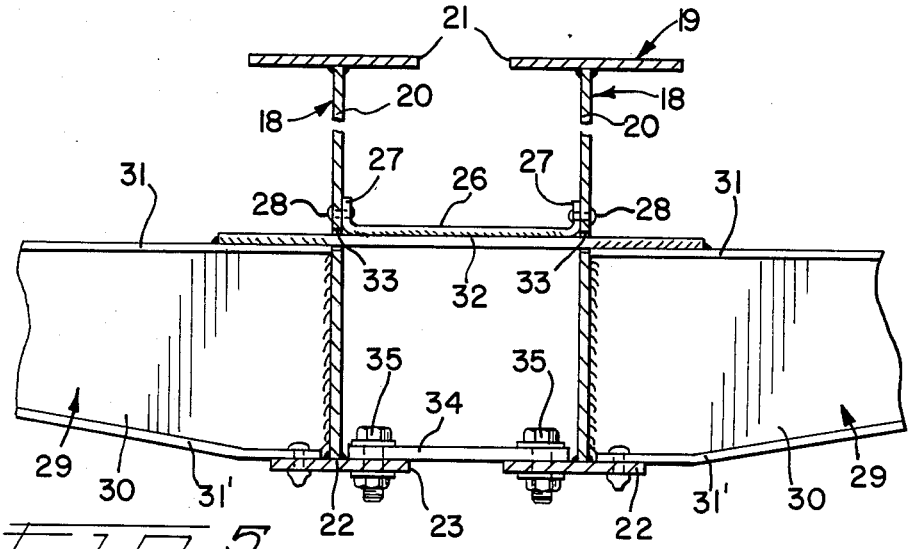
FIG. 4 is a cross sectional view taken substantially along line 4—4 of FIG. 3.
Figure 5:
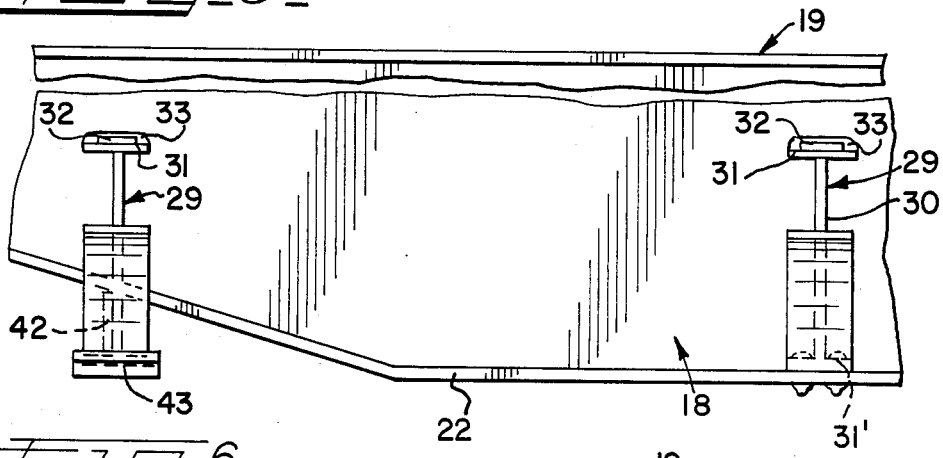
FIG. 5 is a side sectional view of a center sill and cross bearer structure, generally along the line 5—5 of FIG. 2.
Figure 6:
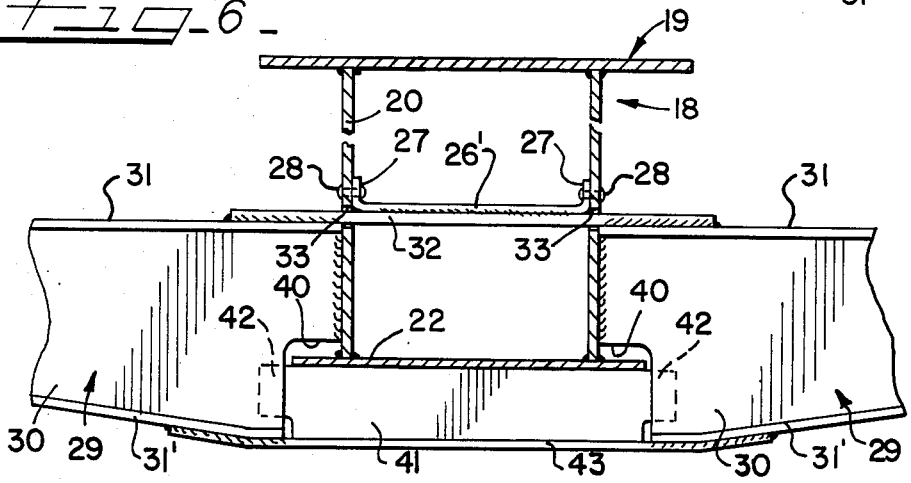
FIG. 6 is a cross sectional view of a modified cross bearer structure taken along the line 6—6 of FIG. 3.
Figure 7:
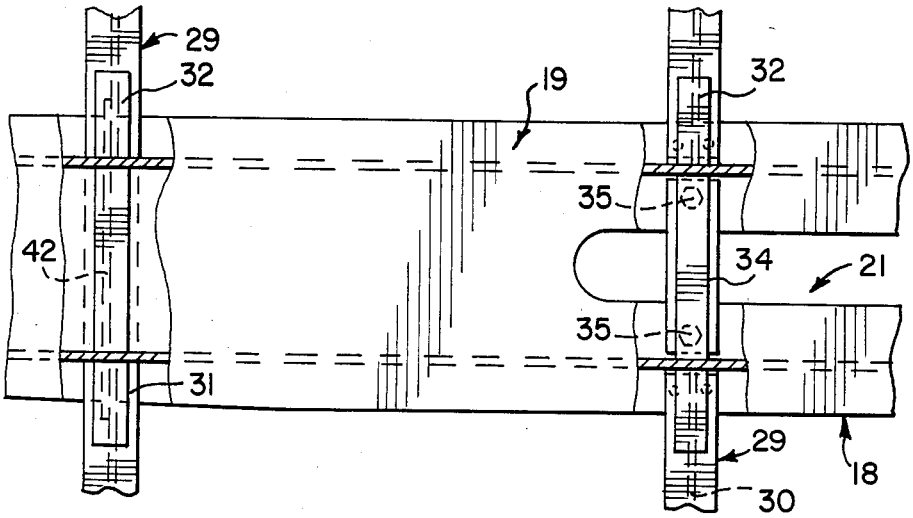
FIG. 7 is a plan view of several cross bearers in which one of the cross bearers is located in one end section of the sill having a tapering reduced height section.

The underframe 14 includes a rigid central or center sill 18 comprising a top horizontal plate 19 connected to vertical plates 20. The horizontal plate 19 includes a horizontal slot 21 and a lower horizontal plate 22 includes a similar slot 23, the two slots being substantially in registry. As best shown in FIGS. 4 and 6, the section of sill which is slotted appears to represent two parallel I-beams.

As best shown in FIG. 3, the sill 18 has a constant vertical height but is provided at opposite ends with transition sections 24 having the lower horizontal plate 22 tapering upwardly and being connected to end sill stubs 25 while still substantially maintaining the shape in cross section of the total sill structure. As best shown in FIG. 2, the slots are contained mainly in the central section of the sill. As best shown in FIG. 2, the transition sections 24 also slope slightly inwardly to the end sill stubs 25. As best shown in FIGS. 2, and 4, a separator channel 26 includes flanges 27 which are secured by suitable fasteners 28 to the side walls 20 of the sill and extend substantially the length of the slots 21 and 23.

A cross bearer structure 29 for the improved sill is disclosed in FIG. 4. A plurality of these structures are utilized in spaced relation along longitudinally spaced portions of the center sill to support deck members 13. The cross bearers 29 comprise vertical webs or walls 30 which may be suitably welded to the sill side walls 20. Each cross bearer structure 29 includes top flanges 31 and bottom flanges 31' welded to the webs 30. The cross bearers extend laterally outwardly from opposite sides of the center sill and support in conventional fashion cargo ramps or deck members 13 as shown in FIG. 1, on each side of the car. The upper plates or flanges 31 are interconnected by a tie plate 32 which extends through aligned openings 33 provided in the vertical sill walls 20. The tie plate 32 is connected to the separator channel 26 and may be welded to the separator channel. The inner ends of the lower plates 31' are riveted to the horizontal sill plate 22. The inner portions of the horizontal sill plate 22 in the region of the cross bearer structures are connected by means of a tie-bar 34 and bolt and nut connections 35.

FIG. 6, taken along line 6—6 of FIG. 3, discloses the construction of the cross bearer in the transition section of the end portions of the center sill structure. As shown, the lower horizontal plate 22 of the center sill tapers upwardly toward the end of the car. The cross bearer structure includes the same essential parts, namely the webs 30 connected to the vertical plates 20 of the sill. The upper flanges 31 also are connected by means of a tie-plate 32 extending through the openings 33 of the center sill and are attached to a short piece of separator channel 26'. In the cross bearer construction in the region of the transition sections the webs 30 are slotted as indicated at 40 to accommodate the angular or inclining tapering portions of lower horizontal plate 22 in the transition sections. As shown in FIG. 6, a transverse tie plate 41 welded to the bottom plate 22 has end wing portions 42 welded to the webs 30 to provide a strong structure. A bottom reinforcing tie plate 43 is rigidly connected to the ends of the lower flanges 31' and tie plate 41.

THE OPERATIONAL FEATURES AND FUNCTION

The present improvement is involved in the invention of an improved underframe which has high non-uniform torsional flexibility and resistance to flexure-torsion buckling. The feature is highly important in railway flat cars wherein the cars are supported on single axle suspensions rather than the four wheel railway car truck.

Due to the uneven profile of American railroad track and the 39 ft. staggered rail used, freight cars (and suspensions) are required to follow rail profiles which raise (or lower) diagonally opposite corners of the car. If the suspension lacks sufficient compliance and the car body has a high torsional stiffness, it is possible for a wheel in the low (valley) portion of the track profile to lift off the rail (car then being supported at its other three corners). If this condition occurs when the car or wheelset is subjected to lateral forces, a derailment is possible.

The standard freight car is isolated from much of this torsional input by the standard "3-piece" truck which uses a centerplate-bowl support system that allows the carbody to rock (or tip) relative to the wheelsets in addition to the flexibility of the springs which accommodate further rail unevenness. However, in the case of the present flat car design which uses single axle suspensions on each end of the car the centerplate-bowl support system is eliminated. Therefore, track profile must be accommodated by the suspension springs and also the carbody as a torsional spring. When this torsional spring is stiff, less overall compliance (carbody plus suspension springs) is available to follow track irregularities (smaller track profile deviation can be tolerated). As a reference, the American Association of Railroads now requires one corner (wheel) of the empty car to be raised 5" without lifting any other wheel. The present flat car design thus requires a torsionally flexible center sill (backbone of the carbody) to aid the suspension in meeting this A.A.R. requirement.

A non-uniform torsionally flexible center sill design is obtained in the present improvement by using a basic box type center sill with a top and bottom slot in the central portion of the car. In this slotted area, the cross-section resembles a double I-beam section joined by a horizontal separator plate 26. Design of the center sill is complicated by other load conditions that must be satisfied while retaining non-uniform torsional flexibility. These load cases are basically compressive loads, and vertical and lateral bending loads. Also, the overall geometry of the car requires a shallow section center sill 24–25 at the end of the car to accommodate the wheelset, suspension, and bolsters while a deeper stronger section is allowed in the central area. It is necessary to slot the stronger, deep section in order to utilize the effect of the end restraint against warping on the magnitude of the angle of twist. The shallow end section must be torsionally rigid to develop non-uniform warping shear and normal stresses in the deep section.

Highway cargo trailers of the fifth wheel hitch type are ideal cargo for railway cars having the invention herein disclosed as they impose essentially a three point loading on the car body structure with the kingpin locked to, but enabled angular movement with respect to, the hitch. Therefore, the relatively rigid structure of the trailer body is not transferred to the railway car in a manner which resists torsional flexing of the center sill.

Figure 8:
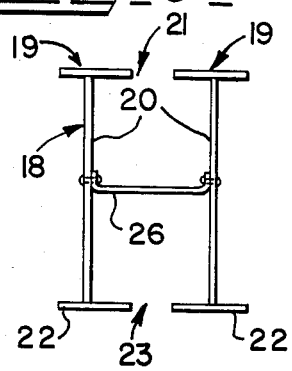
FIG. 8 is a schematic view showing a sill and separator structure in an untwisted position.
Figure 9:
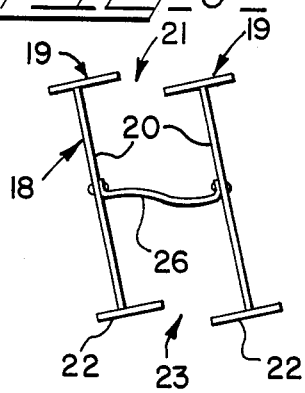
FIG. 9 is a similar view showing the torsional sill in a twisted position.
Figure 10:
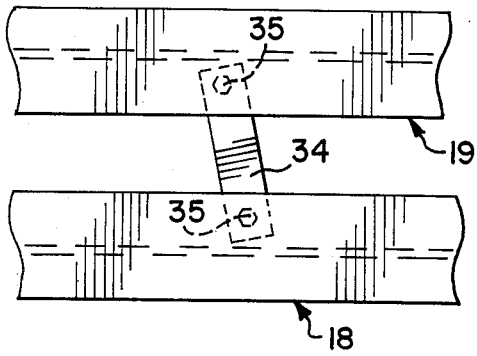
FIG. 10 is a schematic view of the two part cross bearer construction and the loading distribution thereon

In design of an open center sill construction, the problem of buckling under compressive loads (A.A.R. requires 1,000,000 lbs.) is significant. In order to stabilize the slotted deep center sill section (in the shape of two parallel I-beams) the horizontal separator channel or plate 26 is attached between the I-beams near mid-height of the web. Individually each I-beam on figuration has sufficient strength to resist buckling in the vertical direction, but not in the lateral direction (the weak direction of the I-beam). The addition of the horizontal separator forces the two I-beams to act as a unit beam laterally with sufficient buckling strength. However, this separator design does not significantly reduce the torsional flexibility of the individual I-beams. Other means of typically bracing two beams (vertical separators or flange crossbracing) would restrict the warping deflections of the I-beam when twisted. Attaching the separator 26 near mid-height of the I-beam web, uses the portion of the I-beam with minimum motion or distortion due to torsion. The separator 26 is configured as a pressed channel and bolted to the I-beam webs. Some rotational deflection does occur in the web area of the I-beam which is resisted by the relatively low bending stiffness of a flat plate. An exaggerated illustration of this deflection is disclosed specifically in FIGS. 8 and 9.

In addition to the rotation of the I-beam when twisted, the flanges on each side of the slot warp longitudinally relative to each other with maximum warping occurring at midspan and diminishing to zero at the ends. This translation or warping creates difficulties in attaching any lateral beams across both sides of the center sill (I-beams) since any member rigidly attached to both I-beams will restrict the motion of the beams (centered about 12" apart) reducing torsional flexibility and also incurring large loads in the attachment itself. Since the torsional loading from the rail is a repeated occurrence, such points will typically fail due to fatigue. Since the car design required crossbearers 29 (for deck supports) to span both I-beams in the deep center sill section, it is necessary to provide the design as disclosed in FIGS. 4, 5, 6, and 7 in which, effectively, each crossbearer consists of two parts, each cantilevered off one side of a center sill I-beam.

Each I-beam can easily support the vertical load but not the moment resisting forces. Moment resistance is obtained from top and bottom crossbearer flange forces. For loads due to car rocking, the top flange force is reacted through the tie bar 32, into the horizontal separator channel which acts as a beam web for lateral loads. Since this attachment occurs near mid-height of the I-beams torsional deflections and effects are minimized. The bottom flange force is reacted into the bottom flange of each I-beam and shared between both I-beams by the bolted tie link 34 which has rotational freedom about the vertical axis to allow the I-beam flange translation by rotating the link.

For vertical loads only, the moment resisting forces of a crossbearer on one side are transferred through the centersill and react against the forces of the crossbearer on the other side by means of the top (tension) and the bottom (compresssion) tie bars.

Thus it is believed that a new and improved railway car underframe having torsional characteristics which provide for the safe and effective utilization of single axle suspension has been described and disclosed.

What is claimed is:

1. A railway car underframe comprising a center sill including horizontally spaced upright side walls and upper and lower horizontal walls connected to said side walls, each of said horizontal walls including a pair of laterally spaced longitudinally extending middle portions being connected to the side walls, said middle portions defining therebetween a longitudinally extending slot to provide a torsionally flexible sill structure, said slots being substantially aligned with each other, first and second crossbearer assemblies projecting outwardly from opposite sides of said center sill, the first and second crossbearer assemblies each including an upright wall having upper and lower flanges, said lower flanges being connected to the lower horizontal wall of said sill, a connector member extending through said side walls of said center sill connecting said first and second assemblies, and tie means pivotally associated with each of the lower wall middle portions for providing lateral support for the lower wall middle portions in varying positions due to torsional flexure of the center sill.

2. The railway car underframe in accordance with claim 1, said side walls having laterally aligned openings, said connector member extending through said openings.

3. The railway car underframe in accordance with claim 1, said sill including a longitudinally extending separator member connecting the vertical side walls of said sill, said separator member being in adjacent relation to said connector member, and said separator member permitting torsional movement of said sill, and said separator member resisting movement of said upright side walls in a lateral direction.

4. A railway car underframe in accordance with claim 3, said tie means including a tie link connecting the lower horizontal wall middle portions.

5. A railway car underframe in accordance with claim 4, said tie link providing for relative longitudinal movement of said lower wall middle portions in response to torsional twist movement of said sill in operation.

6. A railway car underframe in accordance with claim 5, said tie link being pivotally connected to said lower horizontal wall middle portion.

7. The railway car underframe in accordance with claim 1, said connecting member comprising a strap overlapping said upper flanges of said cross bearer assemblies.

8. A railway car underframe in accordance with claim 1, said sill including a longitudinally extending separator member connected to the upright side walls.

9. The railway car underframe in accordance with claim 8, said separator member being situated on top of said connector member.

10. The railway car underframe in accordance with claim 1, said tie means including a tie link having portions thereof pivotally connected to said lower wall middle portions of said sill for accommodating twisting movement.

11. A railway car comprising:

a pair of single axle railway car trucks; and an underframe adapted to be supported on said car trucks, said underframe comprising a longitudinally extending center sill;

said center sill having longitudinally opposite end portions being operatively associated with said car trucks and a intermediate portion connecting said end portions; said intermediate portion having flexible means providing for torsional flexure to permit relative angular twisting of said end portions along a longitudinal axis to accommodate track profiles which raise opposite corners of the underframe;

said flexible means including a pair of laterally spaced side walls; and a crossbearer assembly supported on the center sill and connected with the side walls;

said crossbearer assembly comprising first and second upright walls extending outwardly from opposite sides of the center sill;

said side walls having a pair of aligned openings at approximately mid-height; and connector means connected with the upright walls and extending through said aligned openings, whereby the connector means undergoes minimum stress resulting from relative warping of the side walls during torsional flexure of the center sill.

12. The invention according to claim 11 and tie means pivotally associated with the lower end of the side walls for providing lateral support of the side walls and crossbearer assembly in varying positions due to relative warpings of the side walls during torsional flexure.

13. The invention according to claim 11 and a pair of bottom flange portions connected to the lower ends of the side walls;

said bottom flange portions defining a space therebetween; and tie means extending across said space and being pivotally connected to said bottom flange portions for providing lateral support of the side walls and crossbearer assembly in varying positions due to relative warping of the side walls during torsional flexure.

14. The invention according to claim 11 and a pair of lower flanges each being connected to a respective upright wall of the crossbearer assembly; and a bottom connector element connecting said lower flanges.

* * * * *